United States Patent [19]

Carmel

[11] 4,378,862

[45] Apr. 5, 1983

[54] PORTABLE SPIRAL STAIRCASE

[75] Inventor: A. Peter Carmel, Peekskill, N.Y.

[73] Assignee: Modular Industries Ltd., New York, N.Y.

[21] Appl. No.: 199,338

[22] Filed: Oct. 21, 1980

[51] Int. Cl.[3] ..... E06C 1/383; A47C 9/12; E04F 11/12

[52] U.S. Cl. ..... 182/106; 182/156; 52/187

[58] Field of Search ..... 182/156, 159, 160, 106, 182/178; 52/187

[56] References Cited

U.S. PATENT DOCUMENTS

| | | | |
|---|---|---|---|
| 737,197 | 8/1903 | Benney | 52/187 |
| 750,998 | 2/1904 | Ohnstrand | 52/187 |
| 1,215,352 | 2/1917 | Duvinage | 52/187 |
| 2,010,588 | 8/1935 | Gooden | 182/106 |
| 3,455,414 | 7/1969 | Higgins | 182/106 |

FOREIGN PATENT DOCUMENTS

| | | | |
|---|---|---|---|
| 2516139 | 10/1976 | Fed. Rep. of Germany | 52/187 |

*Primary Examiner*—Reinaldo P. Machado
*Attorney, Agent, or Firm*—Natter & Natter

[57] ABSTRACT

A self-supporting helical staircase having an interconnected series of radial steps adapted to be swingably opened for providing vertically spaced horizontal support surfaces. The steps are angularly displaceable about a pintel post in progressive increments and are resiliently coupled for snap-lock engagement when in the fully extended position. A vertically extendible elongate handle is housed within the pintel post and can be locked at selected heights by a pressure clamp arrangement mounted at the upper end of the pintel post. The elongate handle can be folded about an articulated joint to a substantially horizontal position when in non-use. A sleeve member is slidable along the handle and can be positioned over the joint to provide vertical rigidity when the handle is to be used.

11 Claims, 7 Drawing Figures

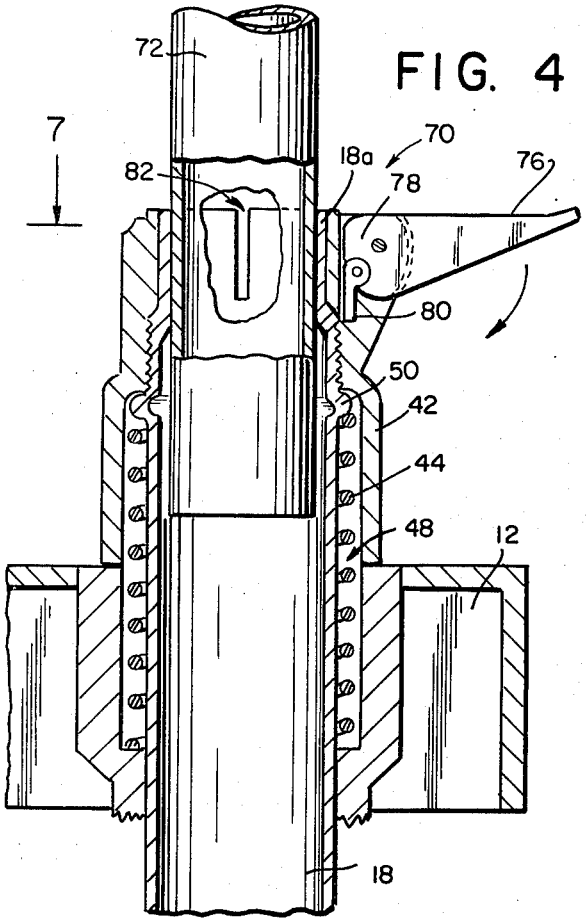
FIG. 4
FIG. 5
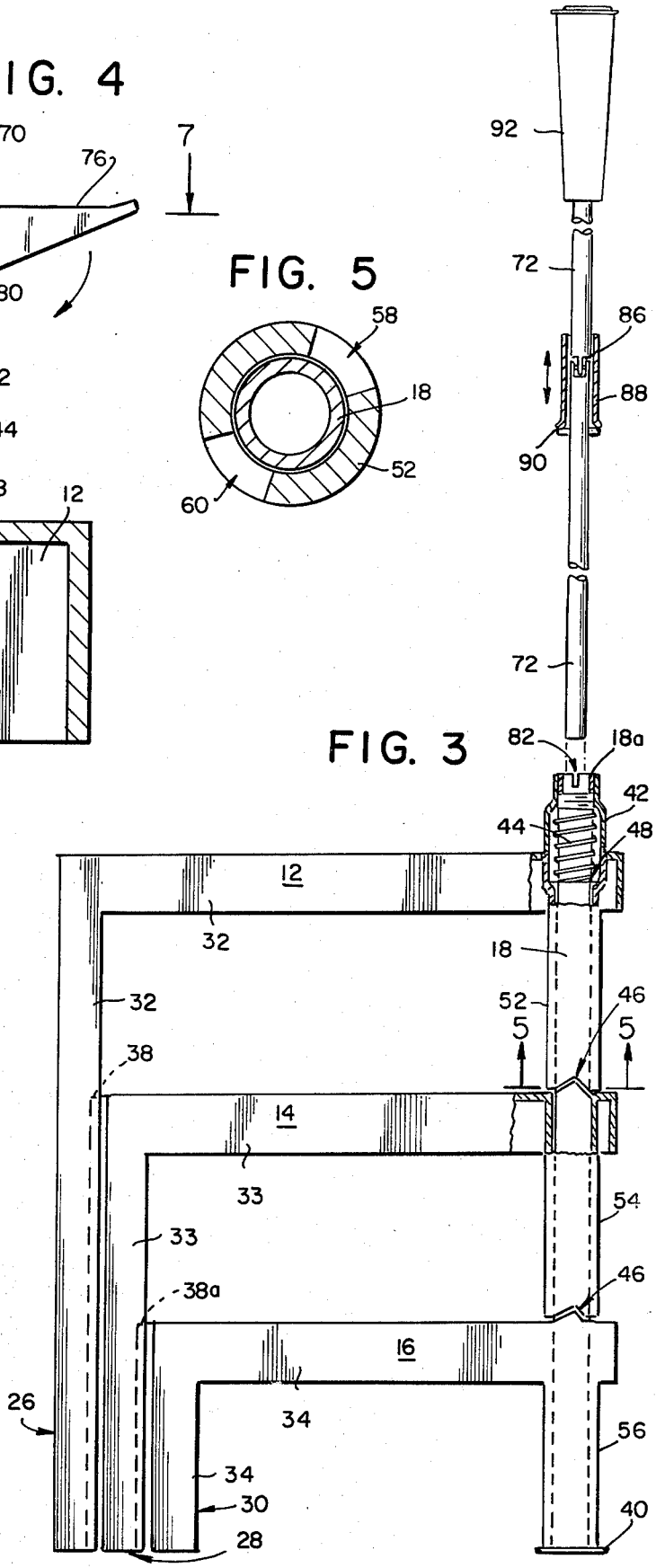
FIG. 3
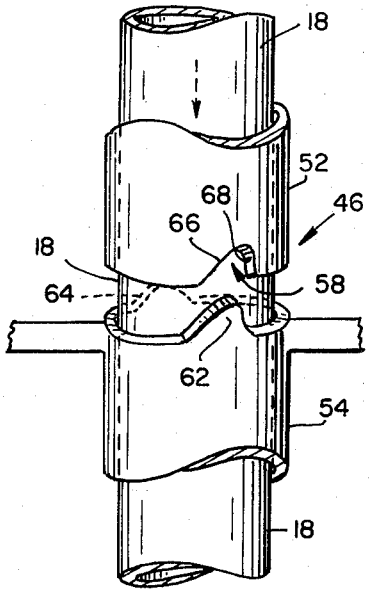
FIG. 6

PORTABLE SPIRAL STAIRCASE

BACKGROUND OF THE INVENTION

1. Field of the Invention

This invention relates generally to a stepped structure and especially to folding stepladders, stepstools and stairways.

In particular, the device of this invention concerns a portable free-standing spiral staircase having swingable steps.

2. Brief Description of the Prior Art

The developmental evolution of the structural design for household or domestic stepstools and folding ladders has not produced significant advancement over the basic concept found in the prior art.

The most commonly known of these devices included the self-supporting folding stepladder which was designed with two opposite side upright members having transverse steps extending therebetween. A top platform was usually provided at the uppermost ends of the upright members. The rear props were pivotally connected to the upright members and the load distribution was thus concentrated at the four points at which the pair of upright members and the rear props rested upon a surface. A typical ladder of this type is illustrated in U.S. Pat. No. 3,139,155.

There were several problems inherent with that hinged stepladder. From the safety point of view, if the rear props were not fully extended or if each of the four legs did not rest on a level surface, the ladder would be unstable. A further disadvantage of those prior art foldable stepladders was that they were rather heavy and cumbersome to use and in many instances of domestic usage such as in a kitchen, they presented a storage problem.

The portable spiral staircase of this invention, in contrast, provides a continuous bearing surface in place of the previous four point contact for greater stability. In addition, this device provides a safety positive locking engagement for the helical steps when in the operative mode.

Previous attempts to provide spiral step arrangements such as shown in U.S. Pat. No. 310,226 have produced cumbersome structures having hinged steps which were not nestable but rather laid in parallel planes. In addition, multiple pivots were employed and a hand support was not present.

It should be readily apparent that the spiral staircase of this invention provides a distinct improvement over those prior art devices and further includes additional advancements for added safety, convenience, multifunctional uses and compact storage.

SUMMARY OF THE INVENTION

Briefly, the nature of this invention concerns a stepped structure providing a portable free-standing stairway.

The intended purpose of this device is to provide an improved functional design for a lightweight, self-supporting structure having elevated supporting surfaces.

In compendium, the portable spiral staircase of this invention includes a plurality of interfitting steps swingable about a common vertical axis. The steps have a substantially horizontal circular segment forming a tread portion and a bearing wall depending normally from the circumferential tread edge. An integral tubular member extends downwardly at the apex of the circular segment and is rotatably mounted about a vertical pintel post. The bearing wall dimension of each of the steps varies in elevation to provide progressively increased heights and an open riser space between the tread portions of the respective steps. Each of the steps can be rotatably displaced about the pintel post from a nested non-operative mode into an open or operative mode.

In order to provide a positive locking engagement for the open steps, the tubular members associated with each of the steps is spring urged for contiguous edge contact whereby a tooth coupling releasably secures the adjacent steps against swingable movement when in use.

The pintel post is further adapted to receive a slidable shaft which is telescopically extendible to provide an elongate handle. The handle can be fixed at selective heights. For this purpose, a pressure clamp is incorporated into an upper end of the pintel post and includes a lever and eccentric cam for clamping the handle at selected locations.

It should be further noted that the handle includes a flexible elbow connection and a companion slidable sleeve positioned around the elbow for immobilizing same to present a rigid vertical support. The upper end of the handle is provided with a hand grip.

Having thus summarized the invention, it will be seen that an object thereof is to provide a portable spiral staircase of the general character described herein which is not subject to the aforementioned disadvantages.

Specifically, it is an object of the instant invention to provide a portable spiral staircase having a plurality of hingedly movable steps forming a progression of raised horizontal wedge shaped tread surfaces.

Another object of this invention is to provide a portable spiral staircase wherein each of the steps is provided with a depending bearing wall for providing a curvilinear bearing support.

It is a further object of the present invention to provide a portable spiral staircase having a series of steps which are nestably engageable for compact storage.

A still further object of this invention is to provide a portable spiral staircase including a telescopically extendible and selectively foldable handle including a companion slidable sleeve for supporting the handle in a vertical orientation.

Yet another object of the instant invention is to provide a portable spiral staircase including a positive locking arrangement for releasably securing the steps against inadvertent swinging movement to furnish added stability when in use.

Yet another object of the present invention is to provide a portable spiral staircase fabricated of plastic material to provide a lightweight durable structure.

Still another object of this invention is to provide a portable spiral staircase which is simple in construction, low in cost, reliable in use and well adapted for mass production fabrication techniques.

Other objects of this invention in part will be apparent and in part will be pointed out hereinafter.

With these ends in view, the invention finds embodiment in certain combinations of elements and arrangements of parts by which the aforementioned objects and certain other objects are hereinafter attained, all as fully described with reference to the accompanying drawings and the scope of which is more particularly pointed out and indicated in the appended claims.

DESCRIPTION OF THE DRAWINGS

In the accompanying drawings in which are shown some of the various possible exemplary embodiments of the invention:

FIG. 3 is an auxiliary elevational view partly in section of the structure shown in FIG. 2 with the handle shown in exploded fashion including a slidable sleeve for selectively stabilizing an articulated connection on the handle and a resilient tooth coupling between contiguous steps;

FIG. 4 is a partial sectional view to an enlarged scale showing an uppermost portion of a pintel post including a spring retainer cap and pressure clamp for adjustably securing the handle at desired locations;

FIG. 5 is a sectional view to an enlarged scale taken substantially along line 5—5 of FIG. 3 showing the spacial arrangement of a tubular member formed integrally with the step and rotatably mounted about the pintel post with opposed recessed areas in the end of the tubular member;

FIG. 6 is a partial perspective view to an enlarged scale illustrating the operation of the toothed coupling, with the broken arrow indicating the spring force for urging frictional contact between the respective tubular members.

DESCRIPTION OF THE PREFERRED EMBODIMENT

Figure 1:
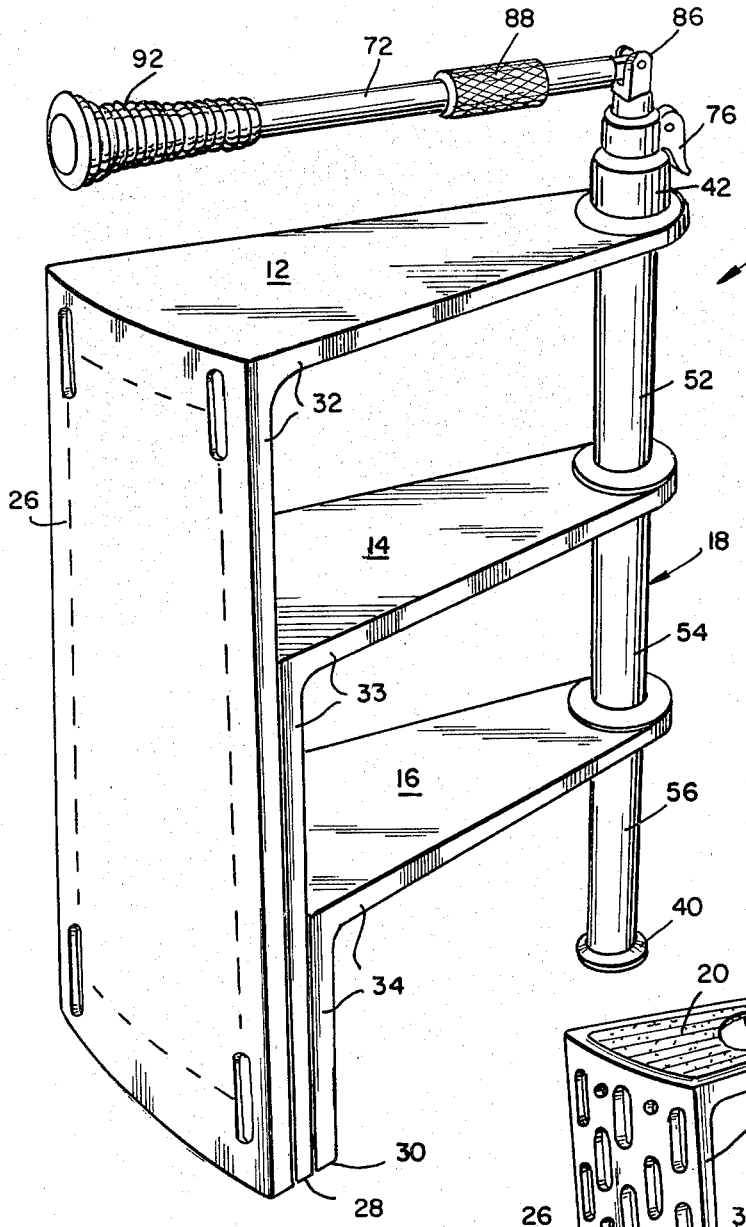
FIG. 1 is a perspective view of a portable spiral staircase of this invention illustrating a non-operative position with a plurality of nested steps and a folded handle.

Referring now in detail to the drawings, the reference numeral 10 denotes generally a portable spiral staircase constructed in accordance with this invention. The staircase 10 includes a plurality of geometrically symmetrical radial steps 12, 14, 16, each subtending substantially equal arc lengths of a common imaginary circle. The steps 12, 14, 16 are rotatably mounted about a pintel post 18 as will be described in further detail hereinafter.

Although the preferred embodiment has been shown and will be described with three steps, a lesser or greater number of steps can be incorporated and are within the scope of this invention. It should also be noted that the steps are preferably fabricated of a thermoplastic material having requisite mechanical and physical properties for providing a lightweight and durable structure.

Figure 2:
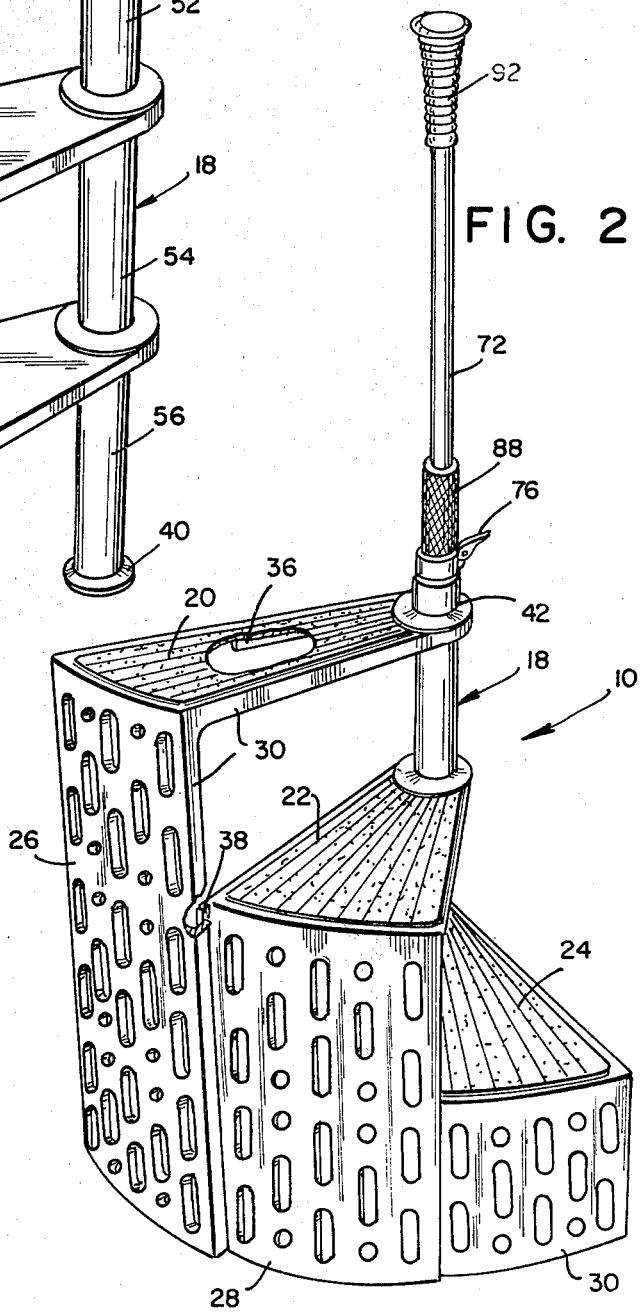
FIG. 2 is a perspective view to a slightly reduced scale showing the portable spiral staircase of this invention with the steps rotatably displaced to an operative mode for providing horizontal support surfaces, and the handle in an alternate upright position; portions of the uppermost step has been broken away for showing the interconnection between adjacent steps and the reinforcing rib.

Each of the respective steps 12, 14, 16 is provided with a tread portion 20, 22, 24 which as noted in the drawings lie in horizontal planes at different elevations and include an open riser space therebetween. Furthermore, the tread portion 20, 22, 24 as illustrated in FIG. 2 can be scored or otherwise texturized to provide a non-skid surface. In addition, a depending cylindrical wall section 26, 28, 30 extends downwardly from each of the corresponding tread portions 20, 22, 24. The cylindrical wall sections 26, 28, 30 are coterminous and thus form a curvilinear bearing for distributing the loading upon the staircase 10. It should be further noted that the cylindrical wall sections 26, 28, 30 can be provided with a geometric arrangement of apertures forming a lattice as illustrated for weight reduction and for decorative purposes.

A marginal skirt 32, 33, 34 lying in a plane orthogonal to the tread portions 20, 22, 24 and extending along the cylindrical wall sections 26, 28, 30 has been included to provide additional shear and bending strength. In addition, supplemental radial ribs 36 underlying the tread 20 and extending perpendicular thereto can also be incorporated in each of the steps for structural reinforcement. The steps 12 and 14 include a radially projecting lip **38,38*a* which is adapted to engage the respective skirt 32,33 of the step 20, 24** for interconnected movement.

The radial length of the treads 20, 22, 24 as well as the height of the cylindrical wall sections 26, 28, 30 are designed to provide clearance for interfitting nestability as shown in FIGS. 1 and 3.

The pintel post 18 is formed from a hollow shaft, preferably of steel or equivalent material and is provided with a flanged base 40 at its lower end and a threaded cap 42 at its upper end.

The pintel post 18 provides a pivot about which the steps 12, 14, 16 can be angularly displaced and locked in an operative mode as illustrated in FIG. 2. This is achieved by utilization of a compression coil spring 44 and a toothed coupling 46. The spring 44 is housed within the pintel cap 42 and extends into a pocket 48 formed in the step 12. The upper end of the spring 44 bears against an annular shoulder 50 which also functions as a limit stop for the threaded connection with the pintel cap 42. The lower end of the spring 44 is compressed and seated within the pocket 48 so formed in the step 12 and thus provides a constant spring force.

The radial steps 20, 22, 24 are provided with a tubular segment 52, 54, 56 extending perpendicularly beneath the respective tread portions 20, 22, 24 at the apex and having an access opening therethrough. The tubular segment 52, 54, 56 is rotatably positionable around the pintel post 18 such that the steps 12, 14, 16 are swingable.

The tooth coupling 46 is formed between confronting edges of the respective tubular segments 52, 54 and 54, 56 and will be described typically with regard to segments 52, 54. In this connection, the edge of the tubular segment 52 has two opposed angular indentations 58, 60 and the tubular segment 54 is provided with two complementary raised sections or a pair of teeth 62, 64 conforming to the indentations as best illustrated in FIGS. 5 and 6. The pair of teeth 62, 64 will fit within the confronting indentations 58, 60 when in angular registration corresponding to the operative displacement of the steps in the position shown in FIG. 2.

It should be further apparent that the spring force will be of sufficient magnitude for this intended locking yet will be yieldable upon application of a requisite torsional force to permit disengagement when returning the steps to the mode shown in FIG. 1. In this regard, the indentations 58, 60 have an obtuse inclined surface 66 on one side and an acute inclined surface 68 on the other side corresponding to the angular orientation of the tooth portion. The obtuse inclined surface 66 facilitates tooth engagement and disengagement while the acute inclined surface 68 provides an abutment to retard excessive rotational movement beyond that required for displacing the steps for operational use. It should also be noted that the previously discussed projecting lip 38,38*a* will also serve to insure correct positioning of the steps and structural stability.

Figure 7:
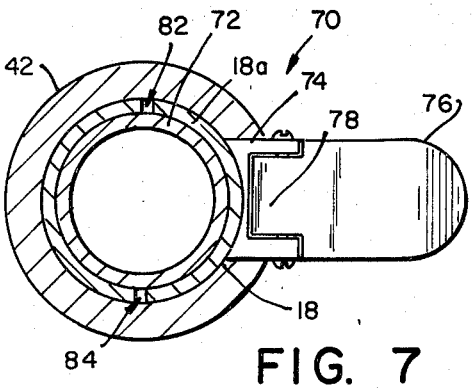
FIG. 7 is a sectional view taken substantially along line 7—7 of FIG. 4 and showing the pressure clamp for compressing a necked down portion of the pintel post including a pair of vertical slots for selectively reducing the diametrical dimension and thus clampingly grasping the handle.

A pressure clamp 70 will now be described with respect to the telescopically extendible handle 72. As noted in FIGS. 4 and 7, the pintel cap 42 includes a yoke member 74 which supports a pivotal lever 76 having an eccentric cam 78. A tongue 80 is pin connected to the cam 78 and has a curved contact surface conforming to the curvature of a necked down portion 18*a* of the pintel post portion 18. When the lever 76 is in a horizontal position as shown in FIG. 4, the handle 72 can be slidably adjusted to a desired height. In order to exert a clamping force, the lever 76 is moved downward in a clockwise direction as indicated by the arrow in FIG. 4 whereby the tongue 80 contacts the necked down portion 18*a* of the pintel post 18 and exerts a pressure which closes a pair of slots 82, 84 to clampingly secure the handle 72. The locked position of the lever 76 is shown in FIG. 1. The reverse movement of the lever 76 in a counterclockwise direction will relieve the clamping pressure such that the slots 82, 84 can re-open and the handle 72 will be released for further height adjustment.

The elongate handle 72 is provided with an articulated joint 86 so that the handle 72 can be folded when in non-use as shown in FIG. 1. When it is desired to position the handle 72 in an upright support position, a sleeve 88 is positionable surrounding the articulated joint 86 and resting upon an annular collar 90 as shown in FIGS. 2 and 3. In addition, the upper end of the handle 72 is provided with a hand grip 92.

Thus it will be seen that there is provided a portable spiral staircase which achieves the various objects of the invention and which is well adapted to meet the conditions of practical use.

Since various possible embodiments might be made of the present invention and various changes might be made in the exemplary embodiment set forth, it is to be understood that all material shown and described in the accompanying drawings is to be interpreted as illustrative and not in a limiting sense.

Having thus described the invention, there is claimed as new and desired to be secured by Letters Patent:

1. A portable spiral staircase in the form of a free-standing structure comprising a plurality of step means for providing horizontal support surfaces, said step means being hingedly mounted to a pintel post for swingable movement and angularly displaceable about a common vertical axis from a nested non-operative mode into an open operative mode, coupling means for releasably securing the steps in the open mode, said pintel post having means adapted for supporting elongate handle means.

2. A portable spiral staircase as claimed in claim 1 further including pressure clamp means for securing said elongate handle means at selected heights above the pintel post.

3. A portable spiral staircase as claimed in claim 2 wherein the pressure clamp includes a pivoted lever, said lever being rotatable for activating an eccentric cam, said cam acting upon the pintel post for clamping the handle.

4. A portable spiral staircase as claimed in claim 3 wherein the elongate handle is provided with an articulated joint.

5. A portable spiral staircase as claimed in claim 4 wherein the elongate handle is provided with a slidable sleeve member, said sleeve being positionable over said articulated joint for immobilizing the handle in a vertical orientation.

6. A portable spiral staircase as claimed in claim 3 wherein each step means includes a cylindrical wall section, said wall section of each step being coterminous to provide a curvilinear bearing wall.

7. A portable spiral staircase as claimed in claim 6 wherein the bearing wall associated with each of the steps varies progressively in elevation to provide correspondingly elevated tread portions, further including an open riser space between consecutive tread portions.

8. A portable spiral staircase as claimed in claim 6 wherein said pintel post extends from a plane coincident with the curvilinear bearing wall.

9. A portable spiral staircase as claimed in claim 1 wherein the step means includes radial steps, each subtending substantially equal arc lengths and having horizontal tread portions.

10. A portable spiral staircase as claimed in claim 1 wherein each step means includes a tubular member, said tubular member being rotatably mounted to the pintel post for swingable movement with relation thereto.

11. A portable spiral staircase as claimed in claim 10 wherein the coupling means includes spring means for urging adjacent tubular members into frictional edge contact, a tooth projection on one of two confronting tubular edges, a companion recess on the other of said tubular edges, whereby the tooth is registrable for seating within a recess during angular displacement of the steps.

* * * * *